US006705852B2

(12) United States Patent
Fujii et al.

(10) Patent No.: US 6,705,852 B2
(45) Date of Patent: Mar. 16, 2004

(54) MELT SPINNING APPARATUS

(75) Inventors: Takashi Fujii, Kyoto (JP); Takashi Iwade, Soraku-gun (JP); Makoto Nishioji, Otsu (JP); Masamichi Yamashita, Otsu (JP)

(73) Assignee: Toray Engineering Company, Limited, Osaka (JP)

( * ) Notice: Subject to any disclaimer, the term of this patent is extended or adjusted under 35 U.S.C. 154(b) by 29 days.

(21) Appl. No.: 10/048,221

(22) PCT Filed: Jun. 20, 2001

(86) PCT No.: PCT/JP01/05251

§ 371 (c)(1),
(2), (4) Date: Jan. 29, 2002

(87) PCT Pub. No.: WO01/98564

PCT Pub. Date: Dec. 27, 2001

(65) Prior Publication Data

US 2002/0114857 A1 Aug. 22, 2002

(30) Foreign Application Priority Data

Jun. 21, 2000 (JP) ..... 2000-185518

(51) Int. Cl.[7] ..... D01D 5/092

(52) U.S. Cl. ..... 425/72.2; 425/378.2; 425/382.2; 425/464

(58) Field of Search ..... 425/72.2, 378.2, 425/382.2, 464

(56) References Cited

U.S. PATENT DOCUMENTS

| | | | | | |
|---|---|---|---|---|---|
| 2,252,684 | A | * | 8/1941 | Babcock | 425/72.2 |
| 3,834,847 | A | * | 9/1974 | Fletcher | 425/72.2 |
| 4,631,018 | A | * | 12/1986 | Valteris et al. | 425/445 |
| 4,681,522 | A | * | 7/1987 | Lenk | 425/72.2 |
| 4,712,988 | A | * | 12/1987 | Broaddus et al. | 425/72.2 |
| 4,820,142 | A | * | 4/1989 | Balk | 348/97 |
| 6,444,151 | B1 | * | 9/2002 | Nguyen et al. | 264/101 |

FOREIGN PATENT DOCUMENTS

| | | |
|---|---|---|
| JP | 55-093816 | 7/1980 |
| JP | 62-085009 | 4/1987 |
| JP | 01-246408 | 10/1989 |
| JP | 8-218217 | * 8/1996 |

* cited by examiner

*Primary Examiner*—Robert Davis
*Assistant Examiner*—Joseph S. Del Sole
(74) *Attorney, Agent, or Firm*—Rader, Fishman & Grauer PLLC

(57) ABSTRACT

There is provided a melt spinning apparatus capable of reducing the unevenness of fineness of a yarn. The nozzles of the spinning plate are arranged annular in at least one circle, and a cylindrical filter is disposed at an exit of a cooling wind in the cooling device so as to enclose around a spun yarn discharged from the spinning plate. The annular diameter of the nozzles is from no less than 0.6 times to no more than one time of the internal diameter of the cylindrical filter, and the flow velocity of the cooling wind blown from the cylindrical filter is distributed gradually higher according to the downstream of the spun yarn.

4 Claims, 4 Drawing Sheets

MELT SPINNING APPARATUS

TECHNICAL FIELD

The present invention relates to a melt spinning apparatus for synthetic yarns and, more particularly, to a melt spinning apparatus capable for spinning yarn having an excellent quality of the unevenness of fineness being reduced.

BACKGROUND OF THE INVENTION

A general melt spinning apparatus of the prior art for manufacturing synthetic resin yarns of polyester or polyamide is constructed, as shown in FIG. 5. Namely, there is arranged a cooling device 51 below a spinning unit 50, and there is arranged a take-up device 52 below the cooling device 51. In the spinning unit 50, there is mounted a spinning pack 54, in which a spinning plate 53 is mounted. The molten polymer is spun as a plurality of filaments f from a plurality of nozzles 55 which are formed in the spinning plate 53. The plurality of filaments f are individually cooled and set with the cooling wind blown from a filter 56 of a cooling device 51 and are taken up on the take-up device 52 after oiled by an oiler roller 57.

In the melt spinning apparatus of the prior art, however, the cooling wind to be blown from the filter 56 of the cooling device 51 flows in only one direction generally perpendicular to the running direction of a spun yarn Y. Depending upon the positions of the plurality of nozzles 55 formed in the spinning plate 53, therefore, the individual filaments f have different states in which they are cooled with the cooling wind, so that they are liable to have different qualities. When the individual filaments f are finally collected as the yarn Y, therefore, there arises a problem that the yarn Y has a large unevenness of fineness (U %) and cannot have a satisfactory quality.

Moreover, the cooling wind blows in only one direction. Depending upon the flow rate of the cooling wind, therefore, the plurality of filaments f are so fluctuated in curved states that they may contact with each other to fuse together. This fusing phenomenon may cause a problem that the unevenness of fineness is enlarged and also a filament breakage is caused. Especially in the case of a large flow rate of the cooling wind, an ascending current occurs in the vicinity of the spinning plate 53 to make the surface temperature of the spinning plate 53 lower and thereby the spinning of the molten polymer unstable. This phenomenon of lowering the surface temperature of the spinning plate 53 is also a cause for increasing the unevenness of fineness or breaking filament.

DISCLOSURE OF THE INVENTION

An object of the present invention is to provide a melt spinning apparatus capable to reduce the unevenness of finenesss of melt spun yarn.

Another object of the present invention is to provide a melt spinning apparatus capable to prevent the breakage of the melt spun yarn.

In order to achieve the above-specified objects, the present invention provides a melt spinning apparatus comprising: a spinning unit disposing a spinning plate having a plurality of nozzles and a cooling device disposed below the spinning plate, wherein the nozzles of the spinning plate are arranged annular in at least one circle, and a cylindrical filter is disposed at an exit of a cooling wind in the cooling device so as to enclose around a spun yarn discharged from the spinning plate.

In the above construction, an annular diameter of the nozzles arranged annular is from no less than 0.6 times to no more than one time of the internal diameter of the cylindrical filter, and the flow velocity of the cooling wind blown from the cylindrical filter is distributed gradually higher according to the downstream of the spun yarn.

As described above, the plurality of nozzles in the spinning plate are so arrayed in at least one circle that they may have an annular diameter of no less than 0.6 times of the internal diameter of the cylindrical filter. On the other hand, in the cooling device, the cylindrical filter is arranged to enclose around a group of filaments spun from a group of the nozzles in an annular array.

Accordingly, the cooling wind blows uniformly around the group of the filaments, so that each of the filaments can be uniformly cooled down. Moreover, the velocity of the cooling wind is so set that it is lower on the upstream side where the coagulation of the spun filaments is not yet complete, but higher on the downstream side where the coagulation has proceeded, thereby to make the filaments coagulated with less uneveness of fineness. Moreover, the flow velocity of the cooling wind is made the slower on the more upstream side so that the surface temperature of the spinning plate can be suppressed to be dropped even if the total flow is increased.

In the aforementioned melt spinning apparatus, for the plurality of grouped nozzles disposed at the spinning plate, it is desired that the center distance between the adjoining nozzles is no less than 8 times of the nozzle diameter. It is, therefore, possible to prevent the filaments from fusing to each other.

For the cooling device, it is desired to provide a cylindrical fow guide of a cooling wind so as to enclose the outer circumference of the cylindrical filter, an inner wall of which is inclined closer to the cylindrical filter on the upper side. By this arrangement of the cylindrical flow guide, there is easily made the distribution in which the flow velocity of the cooling wind is slower on the upstream side of the spun yarn and faster on the downstrean side.

Moreover, a plurality of rectifying vanes may be arranged on the inner wall of the cylindrical fow guide to extend radially toward the center of the cylindrical filter and at intervals in the circumferential direction. Moreover, it is desired to connect a guide tube to the lower end of the cylindrical filter.

BEST MODE FOR CARRYING OUT THE INVENTION

Figure 1:
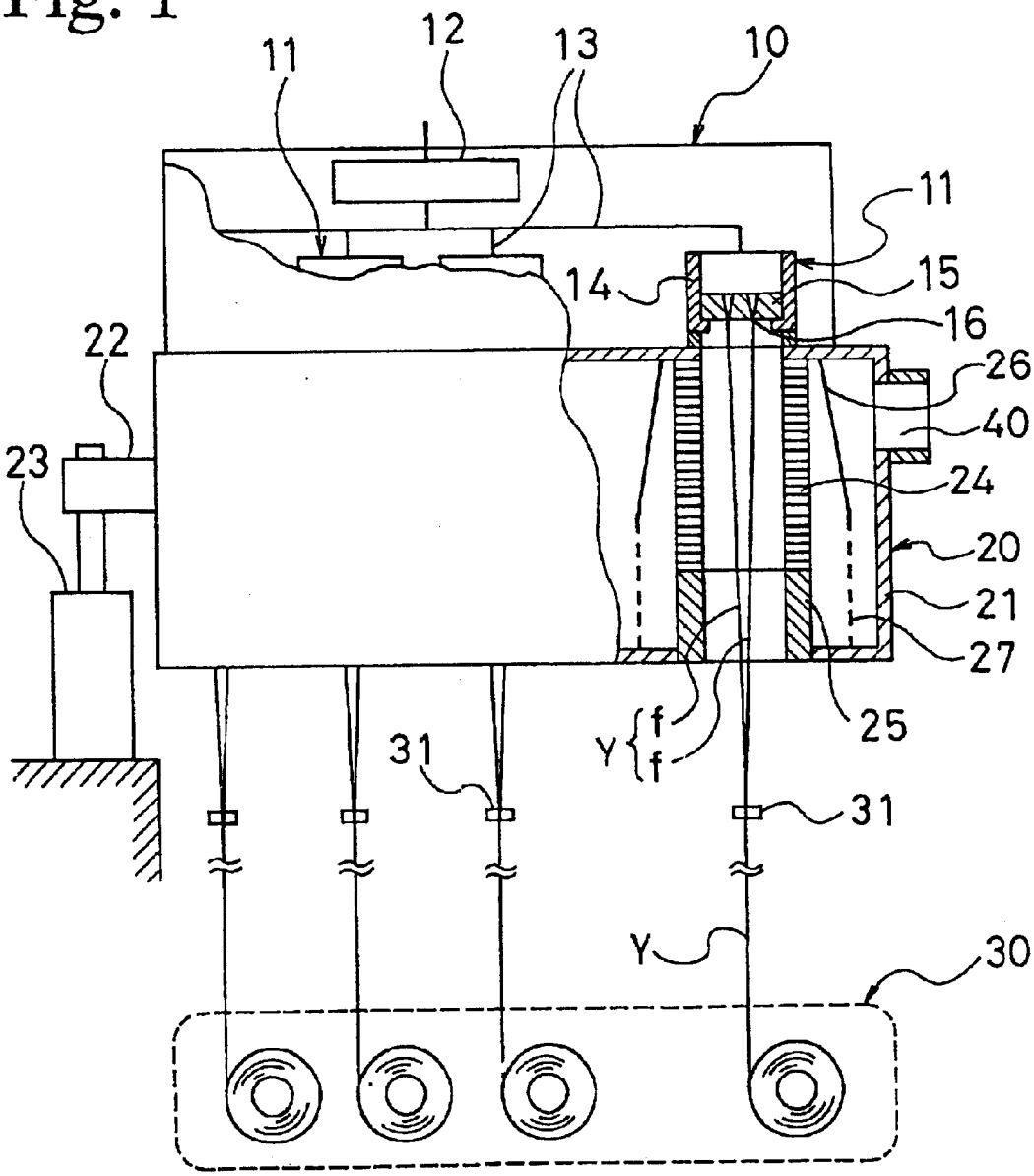
FIG. 1 is a schematic diagram of the entirety of a melt spinning apparatus according to an embodiment of the present invention.

In a melt spinning apparatus of the present invention shown in FIG. 1: reference numeral 10 designates a spin beam; numeral 20 designates a cooling device; and numeral 30 designates a yarn take-up device.

The spin beam 10 is provided therein with a heating/insulating mechanism and a plurality of spinning units 11. To each of the spinning units 11, there is fed a molten polymer via each of a plurality of pipes 13 divided from a metering pump 12. On each of the spinning units 11, there is removably mounted a spinning pack 14, in which a spinning plate 15 having a plurality of nozzles 16 is mounted.

The molten polymer, as fed from the metering pump 12 to each of the spinning units 11, is spun from the nozzles 16 of the spinning plate 15 into a plurality of filaments f. Yarn Y composed of these filaments f is cooled and coagulated by a cooling wind while flowing down in the cooling device 20, and are taken up by the take-up devices 30 after collected by collecting guides 31.

In the lower portion of the spinning beam 10, there is mounted a cover case 21 which forms the outer side of the cooling device 20. This cover case 21 is provided at its one side portion with a bracket 22, through which it is moved up and down by an elevator cylinder 23 so that it can alternately come into and out of contact with the bottom face of the spinning beam 10. By this vertical control of the cover case 21, it is made easy to replace the spinning pack 14 and to clean the spinning plate 15.

Figure 2:
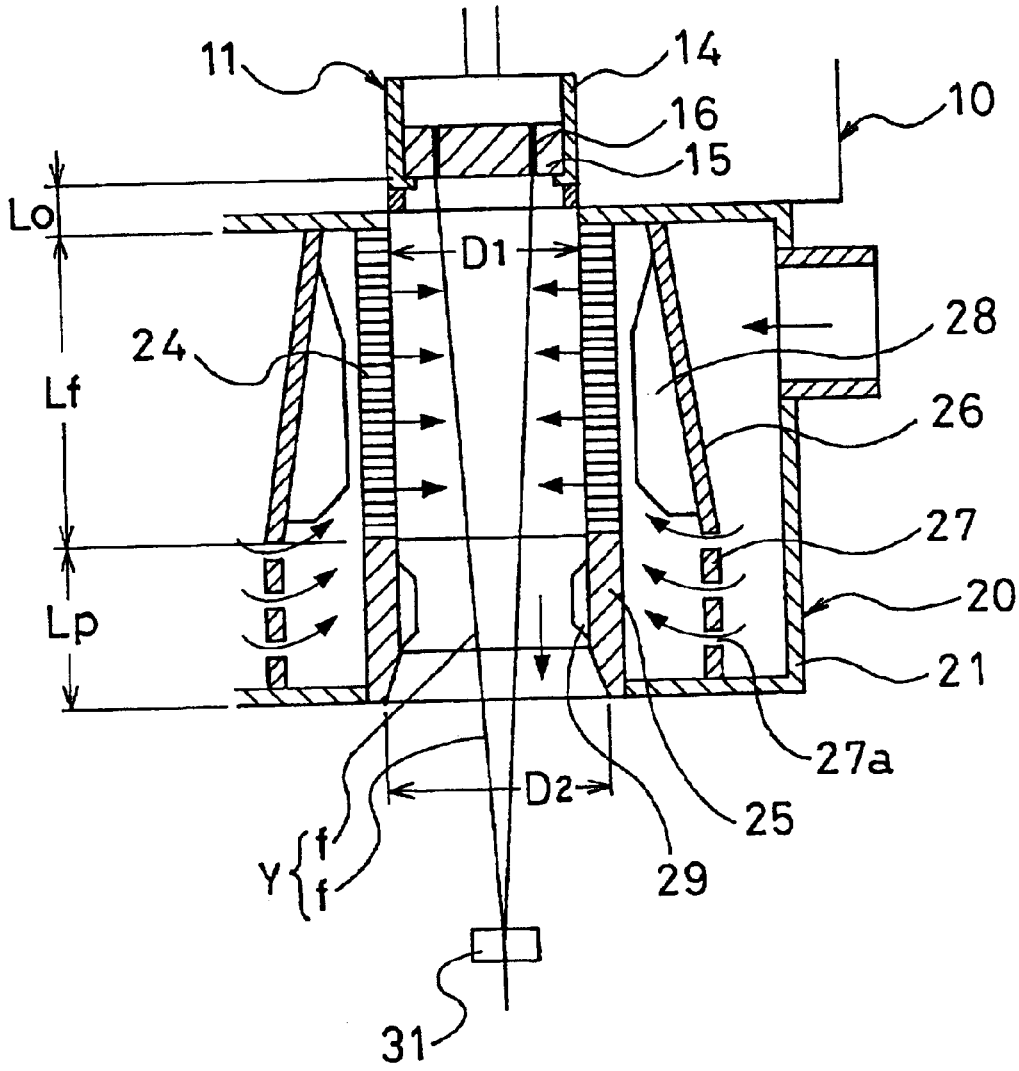
FIG. 2 is a detailed sectional view showing a cooling device in the apparatus of FIG. 1.

FIG. 2 shows the cooling device 20 which is disposed in one of the spinning units 11 provided in the melt spinning apparatus of FIG. 1.

From a plurality of nozzles 16 of the spinning plate 15 in the spinning unit 11, there are spun out of a plurality of filaments f to be a yarn Y. The yarn Y composed of the filaments f is enclosed by a cylindrical filter 24 having an internal diameter D1, which is mounted in the cover case 21. To the lower end of the cylindrical filter 24, moreover, there is connected a guide tube 25 which has the same internal diameter D1 as that of the cylindrical filter 24.

Around the cylindrical filter 24, moreover, there is concentrically arranged a cylindrical flow guide 26 for a cooling wind. To the lower end portion of the cylindrical flow guide 26, there is connected an introducing barrel 27 for a cooling wind which has a number of intake ports 27*a*. The cylindrical flow guide 26 is formed into such a frustum of circular cone that an inner wall comes close to the upper side of the outer circumference of the cylindrical filter 24. Therefore, the cooling wind, which is introduced from the introducing barrel 27 at the bottom end, rises along the cylindrical flow guide 26 and flows in inside of the cylindrical filter 24. The distribution of the flow velocity for the cooling wind is high at the lower portion of the cylindrical filter 24 and becomes lower according to the upper portion.

A cylindrical wall of the cylindrical filter 24 is formed by a number of honeycomb-shaped vent holes which are arrayed radially toward the center axis of the cylindrical filter 24. Therefore, the cooling wind, which is fed to the cylindrical flow guide 26, is blown centripetally toward the axis of the cylindrical filter 24 from the entire circumference thereof to cool uniformly the plurality of filaments f falling down inside. The cylindrical wall of the cylindrical filter 24 is preferably constructed of the honeycomb-shaped vent holes, as described above, but may be constructed of sintered metal, a net-shaped member or a nonwoven fabric.

On the inner circumference of the cylindrical flow guide 26, there are arranged a plurality of rectifying vanes 28 equidistantly in the circumferential direction. These rectifying vanes 28 are so radially fixed that their radially inner end portions are directed to the axis of the cylindrical filter 24. These rectifying vanes 28 suppress the cooling wind coming into the cylindrical flow guide 26 from being swirled, so that the cooling wind may pass through the cylindrical filter 24 while being distributed uniformly in the circumferential direction, thereby to cause no disturbance in the numerous filaments f falling down inside. On the inner wall of the guide tube 25, there are also mounted a plurality of rectifying vanes 29. These rectifying vanes 29 are also arrayed equidistantly in the circumferential direction and radially with their inner ends directed to the axis of the guide tube 25. These rectifying vanes 29 suppress the swirling of an air flow accompanied with the running filaments f to stabilize the running of the filaments f.

Moreover, the guide tube 25 is formed into such a taper shape that its lower end portion has an internal diameter D2 larger than that D1 of its upper side. By this taper tube, it is possible to stabilize the running of the filaments f more.

Figure 3:
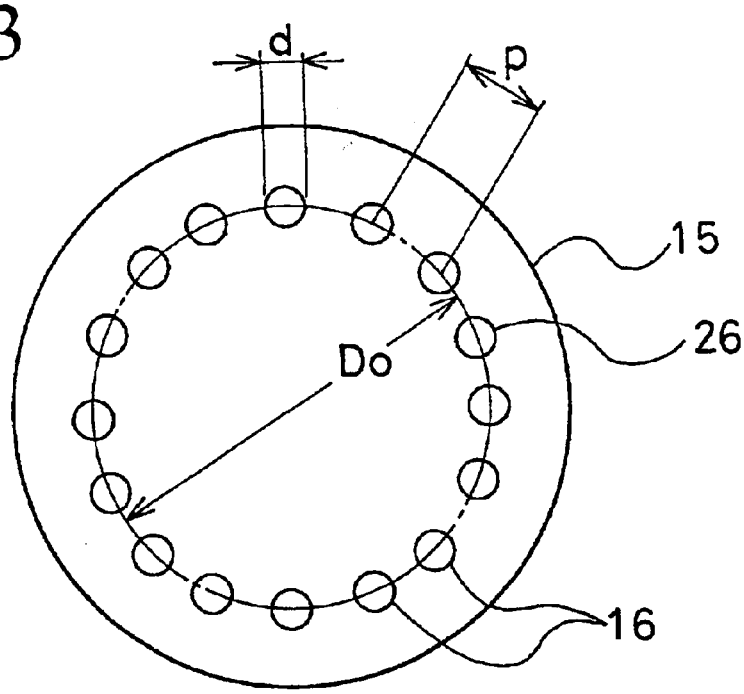
FIG. 3 is a top plan view illustrating a spinning plate to be used in the present invention.
Figure 4:
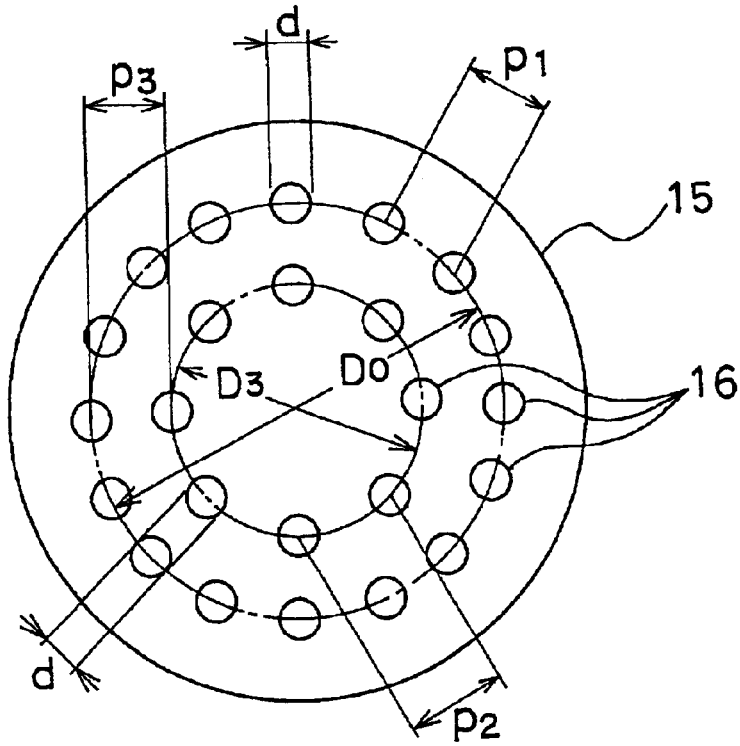
FIG. 4 is a top plan view showing another example of the spinning plate to be used in the present invention.

On the other hand, the spinning plate 15 of the spinning unit 11 is provided with the plurality of nozzles 16. It is necessary that these nozzles 16 are arranged annular in at least one circle. Specifically, the nozzles 16 are arranged annular in one circle, as shown in FIG. 3, or in double circles, as shown in FIG. 4, or in more. In these annular arrangements, moreover, the annular diameters D0 and D3, as drawn through every centers of nozzles 16, are set to be no less than 0.6 times but no more than one time of the internal diameter D1 of the cylindrical filter 24. By this setting of the annular diameters, it is possible to cool uniformly the plurality of filaments f while preventing the filaments from fusing with each other by mutual contact.

The closer the annular diameters D0 and D3 are to the internal diameter D1 of the cylindrical filter 24, the more perpendicular the cooling wind to be blown from the cylindrical filter 24 can be applied to the filaments f, and thereby it is able to improve the cooling efficiency better and to make the unevenness of fineness of the yarn less.

In the group of nozzles arranged annular as aforementioned, more preferably, the center distances p, p1, p2 and p3 (as referred to FIGS. 3 and 4) between the adjoining nozzles 16 may be 8 times or more of the diameter d of the nozzles 16, to make the unevenness of fineness of the yarn further reduced.

In the melt spinning apparatus of the present invention thus far described, the cooling actions are performed in the following manners by the cooling device 20.

First of all, the cooling wind of controlled temperature is fed from the not-shown blower from an inlet port 40 into the cover case 21. This cooling wind is introduced into the introducing barrel 27 in the lower portion of each of the spinning units 20, from which it rises along the cylindrical flow guide 26. While the cooling wind rises along the cylindrical flow guide 26, it is gradually blown inward from the outer circumference of the cylindrical filter 24 to cool the plurality of filaments f falling down in the annular state, from the outer circumference thereof. The individual filaments f are arrayed substantially equidistantly from the inner face of the cylindrical filter 24 so that they are individually uniformly cooled.

The flow velocity of the cooling wind to flow inward from the cylindrical filter 24 has such a gradient that it is slow on the upstream side of the cylindrical filter 24 but becomes fast on the downstream side, because the inner wall of the cylindrical flow guide 26 is inclined. In other words, the slower cooling wind hits the upstream side where the coagulation is insufficient, but the faster cooling wind hits the downstream side where the coagulation has proceeded, so that the cooling action is so efficient as to cause the uneven fineness. By this flow velocity distribution, moreover, the rising flow is weakened in the vicinity of the spinning plate 15 thereby to reduce the fluctuation of the filaments just after spun. As a result, the drop in the surface temperature of the spinning plate 15 can be suppressed to prevent the increase in the uneven fineness or the breakage of the filaments, which might be caused by the lowering in of the surface temperature.

The velocity gradient of the cooling wind is preferably so set that the flow velocity at a position of (½)Lf is one time or more of a flow velocity V0 and that the flow velocity at a position of (¾)Lf is 1.5 times or more of the flow velocity V0, as shown in FIG. 2, if the cylindrical filter 24 has the length Lf and if the blowing velocity of the cooling wind at the position of (¼) Lf from the upper face of the cylindrical filter 24 is at the value V0 for optimizing the surface temperature of the spinning plate. This velocity gradient can be easily set by adjusting the angle of inclination of the inner wall of the cylindrical flow guide 26. Moreover, this velocity gradient can also be obtained by changing the shape of the cylindrical filter 24 or the density of the vent holes.

The cooling wind, which is blown inward of the cylindrical filter 24, flows down as the accompanied flow of the yarn Y in the guide tube 25 while cooling the yarn Y. If this accompanied flow is disturbed, the single filaments f are fluctuated to run unstably. The unstable running arised from fluctuation of the single filaments f can be avoided by setting the length Lp of the guide tube 25 at one third or more of the internal diameter D1 of the cylindrical filter 24.

When the feed of the cooling wind to the cylindrical filter 24 is increased, moreover, the accompanied flow of the yarn Y may increase to cause the swirling flow in the guide tube 25 to disturb the yarn Y. This swirling flow can be effectively suppressed by providing the rectifying vanes 29 in the guide tube 25. If the lower end portion of the guide tube 24 is formed in a taper shape, moreover, this taper portion can weaken the accompanied flow to stabilize the single filaments.

According to the present invention, as has been described hereinbefore, the plurality of nozzles in the spinning plate are so arrayed annular in at least one circle that they may have an annular array diameter of no less than 0.6 times of the internal diameter of the cylindrical filter, and on the hand, in the cooling device, the cylindrical filter is arranged to enclose around the group of the filaments spun in the annular state from the group of nozzles to blow the cooling wind uniformly from outside of the group of the filaments, so that each of the filaments can be uniformly cooled down. Moreover, the velocity of the cooling wind is so set that it is lower on the upstream side where the coagulation is not yet complete, but higher on the downstream side where the coagulation has proceeded, to make the coagulation effect less with uneven fineness. Moreover, the flow velocity of the cooling wind is made slower on the upstream side so that the surface temperature of the spinning plate can be suppressed to be dropped even if the total flow is increased.

EXAMPLE 1

A polyester yarn of 120dtx-36f was manufactured: by using the spinning plate and the melt spinning apparatus, as specified hereinafter; by setting the flow velocity of the cooling wind in the cooling device at 21 m/min at a position of (¼)Lf from the upper face of the cylindrical filter, at 25 m/min at a position of (½)Lf, and at 32 m/min at a position of (¾)Lf; by melt-spinning polyethylene terephthalate at a spinning temperature of 293° C.; and by taking-up the yarn at a taking-up velocity 3,300 m/min.

The unevenness of fineness (U %) measured for the polyester yarn thus obtained was 0.7%.

Specifications of Spinning Plate:

Thirty six nozzle ports having a port diameter d of 0.25 mm were arrayed annular in one circle; the center distance p between the adjoining nozzle ports was set at 6.1 mm; and the annular array diameter D0 was set at 70 mm.

Specifications of Melt Spinning Apparatus:

The structure of FIG. 1 was made; and the cylindrical filter had sizes of L0=40 mm, Lf=20 mm, and Lp=50 mm.

Comparison 1

Figure 5:
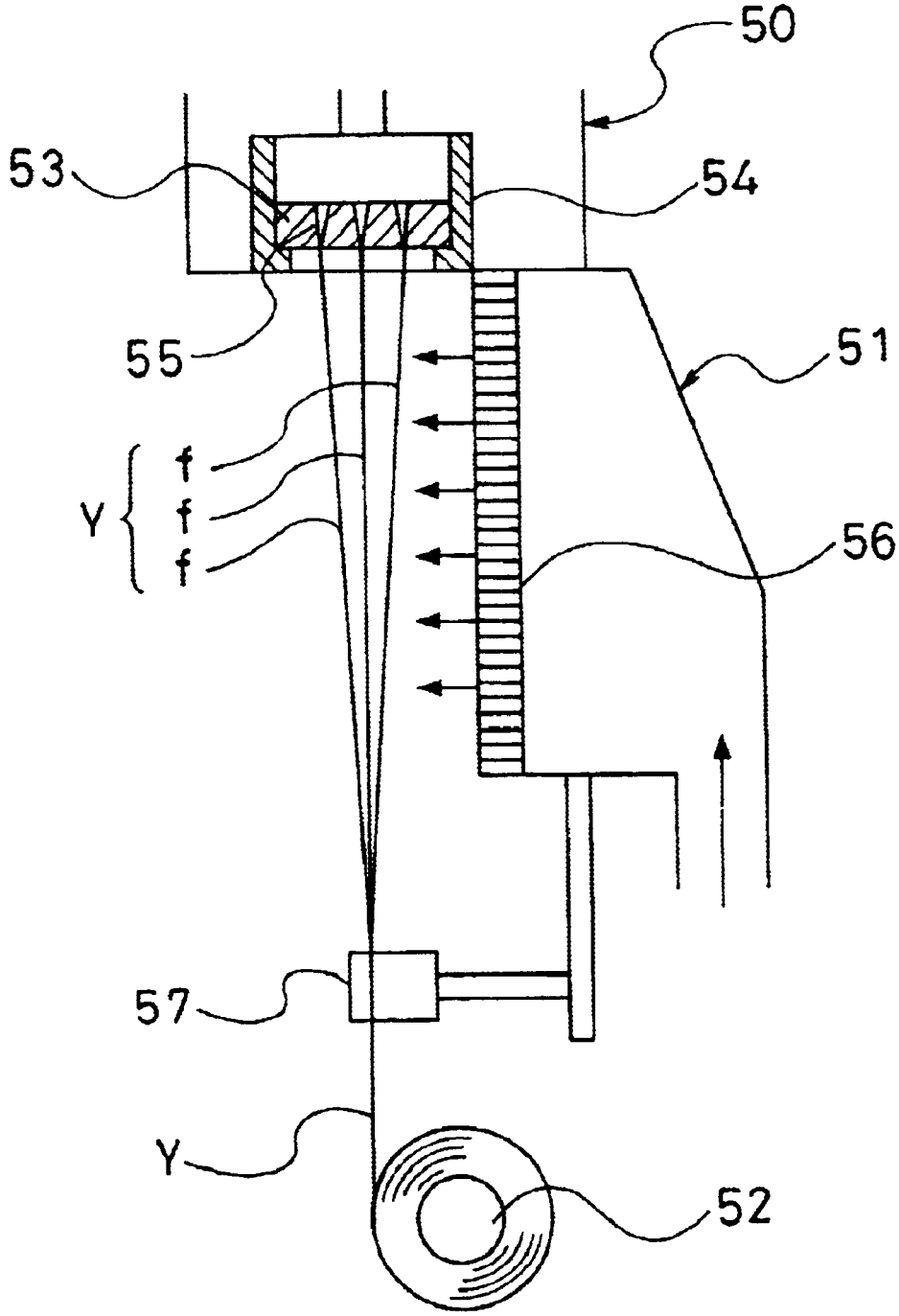
Fig. 5 PRIOR ART
FIG. 5 is a schematic diagram showing a melt spinning apparatus of the prior art.

A polyester yarn of 120 dtx-36f was manufactured: by using the same spinning plate as that of Example 1; by using the melt spinning apparatus having the structure of FIG. 5; by setting the flow velocity of the cooling wind at 18 m/min.; and by melt-spinning and taking up polyethylene terephthalate at the same spinning temperature and taking-up velocity as those of Example 1.

The unevenness of fineness (U %) measured for the polyester yarn thus obtained was 1.1% that was inferior to Example 1.

EXAMPLE 2

A polyester yarn of 120 dtx-36f was manufactured: by using the same spinning plate and melt spinning apparatus as those of Example 1; by setting the flow velocity of the cooling wind in the cooling device at 20 m/min at a position of (¼)Lf from the upper face of the cylindrical filter, at 28 m/min at a position of (½)Lf, and at 40 m/min at a position of (¾)Lf; by melt-spinning polyethylene terephthalate at a spinning temperature of 293° C.; and by taking-up the yarn at a taking-up velocity 4,000 m/min.

The unevenness of fineness (U %) measured for the polyester yarn obtained was 0.9%.

Comparison 2

A polyester yarn was manufactured: by using the same spinning plate as that of Example 2; by using the melt spinning apparatus having the structure of FIG. 5; by setting the flow velocity of the cooling wind at 22 m/min; and by melt-spinning and taking up polyethylene terephthalate at the same spinning temperature and taking-up velocity as those of Example 2.

The unevenness of fineness (U %) measured for the polyester yarn thus obtained was 1.2% and inferior to Example 2.

INDUSTRIAL APPLICABILITY

The present invention can be effectively applied to the field of manufacturing synthetic fibers, especially to the manufacture field by the melt spinning method.

What is claimed is:

1. A melt spinning apparatus comprising:

a spinning unit disposing a spinning plate having a plurality of nozzles and a cooling device disposed below said spinning plate, wherein the nozzles of said spinning plate are arranged annular in at least one circle, and a cylindrical filter is disposed at an exit of a cooling wind in said cooling device so as to enclose around a spun yarn discharged from said spinning plate, the annular diameter of said at least one circle being from no less than 0.6 times to one time of the internal diameter of said cylindrical filter, and the flow velocity of the cooling wind blown from said cylindrical filter being distributed gradually higher according to the downstream of the spun yarn, and wherein a plurality of rectifying vanes are arranged on an inner wall of said cylindrical flow guide to extend radially toward the center of said cylindrical filter and at intervals in the circumferential direction on said inner wall.

2. A melt spinning apparatus as set forth in claim 1, wherein the center distance between the adjoining nozzles in said plurality of nozzles is no less than 8 times of the diameter of said nozzles.

3. A melt spinning apparatus as set forth in claim 1 or 2, wherein a cylindrical flow guide for said cooling wind is disposed to enclose an outer circumference of said cylindrical filter, an inner wall of said cylindrical flow guide made inclined close to an upper side of said cylindrical filter.

4. A melt spinning apparatus as set forth in claim 3, wherein a guide tube is connected to the lower end of said cylindrical filter.

* * * * *